US010760274B2

(12) United States Patent
Fornasier et al.

(10) Patent No.: US 10,760,274 B2
(45) Date of Patent: Sep. 1, 2020

(54) SYSTEM AND METHOD TO PRODUCE A BITUMINOUS MEMBRANE SUPERFICIALLY COVERED BY GRAIN-BASED DECORATIONS

(71) Applicant: EUROLINE S.R.L., Maserada sul Piave (IT)

(72) Inventors: Antonio Fornasier, Maserada sul Piave (IT); Alessandro Pavan, Maserada sul Piave (IT)

(73) Assignee: EUROLINE S.R.L., Maserada sul Piave (IT)

( * ) Notice: Subject to any disclaimer, the term of this patent is extended or adjusted under 35 U.S.C. 154(b) by 188 days.

(21) Appl. No.: 15/784,035

(22) Filed: Oct. 13, 2017

(65) Prior Publication Data

US 2018/0106043 A1 Apr. 19, 2018

(30) Foreign Application Priority Data

Oct. 13, 2016 (IT) ..... 1020160102772

(51) Int. Cl.
*E04D 1/20* (2006.01)
*B05C 19/04* (2006.01)
(Continued)

(52) U.S. Cl.
CPC ..... *E04D 1/20* (2013.01); *B05C 19/04* (2013.01); *E04D 5/02* (2013.01); *E04D 5/12* (2013.01);
(Continued)

(58) Field of Classification Search
None
See application file for complete search history.

(56) References Cited

U.S. PATENT DOCUMENTS 1,599,512 A * 9/1926 Cady ..... D06B 3/10 118/114
1,676,351 A * 7/1928 Robinson ..... B28B 19/00 52/559
(Continued)

FOREIGN PATENT DOCUMENTS

WO WO 2015/125089 A1 8/2015

OTHER PUBLICATIONS

Italian Search Report for Counterpart Italian Patent Application No. 102016000102772, 8 pgs. (dated May 30, 2017).
(Continued)

*Primary Examiner* — Jethro M. Pence
(74) *Attorney, Agent, or Firm* — Womble Bond Dickinson (US) LLP

(57) ABSTRACT

A system to produce a bitumen-based membrane provided with a bituminous surface covered by grains. The system comprises a movement device designed to more a preformed membrane in a predefined feed direction, a grain application machine comprising a rotating application drum provided with a plurality of cavities which are designed to receive grains in a loading region of said drum, a grain loading device designed to load the grains in the cavities in the loading region of the drum, and a grain retention device made of sintered polymer material, which is arranged in contact with a retention region for retaining the outer surface of the application drum so as to maintain the grains in the cavities until the latter reach an angular discharge position.

9 Claims, 4 Drawing Sheets

(51) Int. Cl.

| | |
|---|---|
| ***E04D 5/02*** | (2006.01) |
| ***E04D 5/12*** | (2006.01) |
| *B05C 19/06* | (2006.01) |
| *E04D 1/00* | (2006.01) |

(52) U.S. Cl.
CPC ..... *B05C 19/06* (2013.01); *E04D 2001/005* (2013.01)

(56) References Cited

U.S. PATENT DOCUMENTS

| | | | | |
|---|---|---|---|---|
| 1,756,989 | A * | 5/1930 | Overbury ..... | D06N 5/00 52/559 |
| 5,814,369 | A | 9/1998 | Bockh et al. | |
| 2015/0072073 | A1 | 3/2015 | Svec | |

OTHER PUBLICATIONS

Hambir Sangeeta, et al., "Sintering of ultra high molecular weight polyethylene," Bull. Mater. Sci., vol. 23, No. 3, pp. 221-226 (Jun. 2000).

* cited by examiner

SYSTEM AND METHOD TO PRODUCE A BITUMINOUS MEMBRANE SUPERFICIALLY COVERED BY GRAIN-BASED DECORATIONS

PRIORITY CLAIM

This application claims priority from Italian Patent Application No. 102016000102772 filed on Oct. 13, 2016, the disclosure of which is incorporated by reference.

TECHNICAL FIELD

The present invention relates to a system and method to produce a bitumen-based membrane superficially covered by grain-based decorations.

In particular, the present invention concerns a system for producing a belt-shaped/laminated sheath or membrane produced by means of a bitumen-based mixture or blend, for example a modified bitumen, air-blown bitumen or distilled bitumen, and superficially covered by grain decorations. The membrane subject of the present invention can be suitably applied in the building sector to produce waterproofing and/or sealing layers and preferably, but not necessarily, for covering roofs, and/or any part of a building; to which the following description shall make explicit reference, without any loss of generality.

BACKGROUND OF THE INVENTION

It is known that the bitumen-based membranes of the type described above have a multilayer structure comprising: a central supporting layer which is produced by means of a film made of flexible material trapped between two outer bituminous layers, an upper layer and a lower layer, opposite each other. Some types of bituminous membranes used to waterproof roofs have a larger surface covered by an outer granular layer which, in addition to protecting the membrane from atmospheric agents, is distributed on the surface to form a predefined decorative design, which generally represents the modular elements traditionally used for covering roofs, for example shingles, or flat or curved tiles.

The above-mentioned surface decoration of the membrane can be provided by different methods, some of which entail rotating an application drum provided with surface cavities, moving the bitumen-based membrane below the application drum, filling the cavities of the drum with covering grains, temporarily maintaining the covering grains in the cavities until the latter reach a certain angular position in which the grains are released from the cavities and are thus deposited by gravity on the surface to be decorated of the membrane below.

U.S. Pat. No. 5,812,369 describes a method of the type described above in which the grains are retained in the cavities by means of a flexible belt wound in a ring around a plurality of wheels and arranged at the back of the application drum so as to superficially envelop the semi-circumference of the drum arranged on the side where the grains are deposited, thus temporarily occluding the cavities during the rotation of the application drum.

The technical problem of this solution is that, during the feeding phase, some grains are deposited on the outside of the cavities and remain trapped between the belt and the surface of the application drum and are deposited in an uncontrolled manner on the membrane, causing irregularities/blurring on the lines/contours of the decoration which therefore spoil the decorative pattern. Furthermore, the grains trapped between the drum and the belt superficially abrade both the application drum and the belt itself. If said abrasion is continuous, in the long term it will damage both the drum and the belt which consequently have to be replaced, resulting in increased costs in terms of production, maintenance, machine standstills, etc.

WO 2015 125 089 A1 also describes a method of the type described above, in which the grains are temporarily retained in the cavities prior to depositing thereof by means of an occlusion roller made of elastically deformable material, instead of a flexible belt. The occlusion roller is positioned in contact with the application drum on the side on which the grains are deposited, thus partially deforming on the same side and therefore forming a sliding elastic surface portion which compresses the grains inside the cavities and cleans the surface of the drum during the rotation thereof.

The technical problem associated with this solution is represented by the fact that the occlusion roller, being made of deformable elastic material and being continually pressed against the drum, is subject to rapid wear by the latter and consequently has to be replaced often, with all consequent drawbacks.

Furthermore, depositing of the grains is often inaccurate. In fact, positioning of the roller axis on the horizontal centreline plane on which the drum axis lies and sizing of the sliding elastic surface portion which extends below the horizontal centreline plane are such that discharge of the grains from the cavity can commence when the cavity is positioned in the lower portion of the roller, well below the horizontal centreline plane thereof. In this way, the cavity is free to discharge when it is already substantially facing the membrane. Consequently, the initial discharge of the grains is carried out in an uncontrolled manner, i.e. not gradual, and can cause blurring on the lines of the decoration which impair the aesthetic effect thereof.

The Applicant has therefore carried out a detailed, study with the aim of identifying a simple and inexpensive solution for implementing a method to produce a bitumen-based membrane superficially covered by grain-based decorations which overcomes the technical problems highlighted above.

SUMMARY OF THE INVENTION

The objective of the present invention is therefore to make available a solution for achieving the above objective.

This objective is achieved by the present invention which is relative to a system and method to produce a bitumen-based membrane superficially covered by grain-based decorations as described in the attached claims.

The present invention further concerns a machine for decorating a bitumen-based membrane by means of covering grains as described in the attached claims.

BRIEF DESCRIPTION OF THE DRAWINGS

The present invention will now be described with reference to the accompanying drawings, which illustrate a non-limiting embodiment example thereof, in which.

DETAILED DESCRIPTION OF THE INVENTION

The present invention will now be described in detail with reference to the attached Figures to allow a person skilled in the art to produce it and use it. Various modifications to the embodiments described will be immediately evident to persons skilled in the art and the general principles described can be applied to other embodiments and applications without departing from the protective scope of the present invention, as defined in the attached claims. Therefore, the present invention must not be considered limited to the embodiments described and illustrated, but must be given the widest protective scope in accordance with the principles and characteristics described and claimed herein.

The meaning of some terms used in the present description and in the claims, will now be defined.

By "membrane" we mean a flat multilayer structure with predefined width based on a bituminous mixture, comprising: at least one central supporting layer which is produced by means of a central tape or film made of flexible paper, plastic material or fabric or any similar flexible material, and at least two lower and upper bituminous layers, fixed on respective larger lower and upper surfaces, opposite each other, of the central supporting layer so as to trap/embed said central supporting layer in a stable manner. The membrane can be ribbon-shaped/laminated and be sized so that it can be wound to form a roll/coil. The membrane subject of the present invention is further structured to be preferably used, for example, as a waterproofing and decorative bituminous membrane for roof. It is understood that the use of the membrane is not limited to application on a roof; other types of application can be envisaged, such as applications for covering/coating any other surface/wall of a dwelling/building.

By "bituminous mixture" it is understood a mixture or compound based on natural hydrocarbons or residues deriving from the distillation or refining of oil and mixed in a known way, and therefore not described in detail (forming tar, asphalt or in general a mixture of high viscosity hydrocarbons), to which a certain quantity of polymer material is preferably, but not necessarily, added. The polymer material can comprise: APP (acronym for atactic polypropylene) and/or SBS (acronym for Styrene-Butadiene-Styrene) and/or polyolefins (for example APAO—Amorphous Poly Alpha Olefin and/or TPO thermoplastic polyolefins), and/or styrene-butadiene-styrene (SBS), and/or styrene-ethylene-butadiene-styrene (SEBS), and/or resins, or similar substances.

By the term "covering grains" we mean flakes or fragments or tiny solid particles finely chopped (dimensions smaller than 1.5 mm); they can comprise for example granules, sand, grit, and can be composed of minerals, for example slate, basalt, ferrite or any similar mineral.

Figure 1:
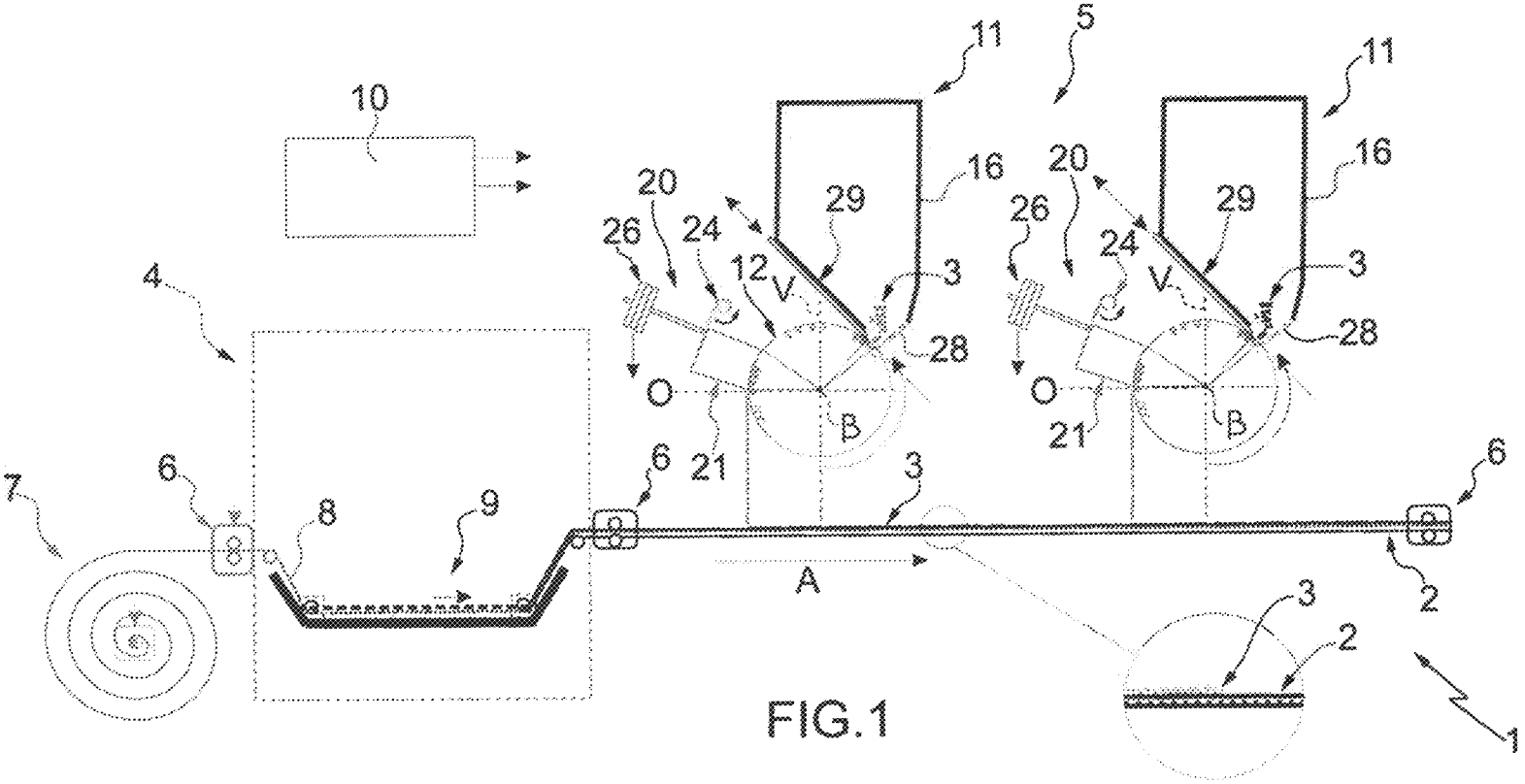
FIG. 1 schematically shows a system for producing a bitumen-based membrane superficially covered by grain-based decorations produced according to the teachings of the present invention.
Figure 8:
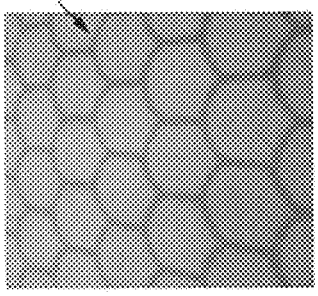
FIGS. 7 and 8 are photographs of the decorated surface of two bituminous membranes obtained by implementing the method subject of the present invention.
Figure 7:
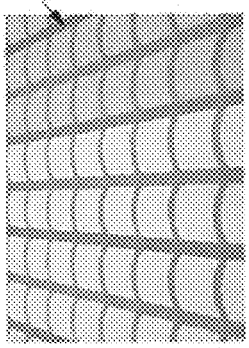

With reference to FIG. 1, the number 1 indicates a system that carries out a process/method for producing a membrane 2 superficially covered by a decoration formed of covering grains 3.

According to a preferred embodiment shown in FIG. 1, the system 1 can comprise: a forming station 4 designed to preform/prefabricate the membrane 2, and a coating station 5 designed to superficially coat, at least partially, the preformed membrane 2 with coating grains 3.

The system 1 can further comprise membrane feeding/moving means provided, for example, with idle/motorized rollers (not illustrated) rotated by relative drive units, for example electric motors controlled by an electronic control unit 10 for feeding the membrane 2 along a direction A, preferably approximately horizontal, for example rectilinear, thus crossing in sequence the forming station 4 and the coating station 5.

The membrane feeding/moving means 6 and the forming station 4 of the membrane 2 are of known type and consequently will not be further described apart from specifying that the forming station 4 can be structured to carry out the following operating phases: unwind from a roll or coil 7 a layer designed to form the central supporting layer 8 of the membrane 2, feed forward the supporting layer 8 immersing it, for a section of its travel, in a controlled manner, in an impregnation tank 9 containing the hot bituminous compound in a semi-liquid and viscous state, thus causing the bituminous blend to adhere/attach to the opposite larger surfaces of the supporting layer 8 so as to form the lower and upper bituminous layers of the preformed membrane 2.

Figure 2:
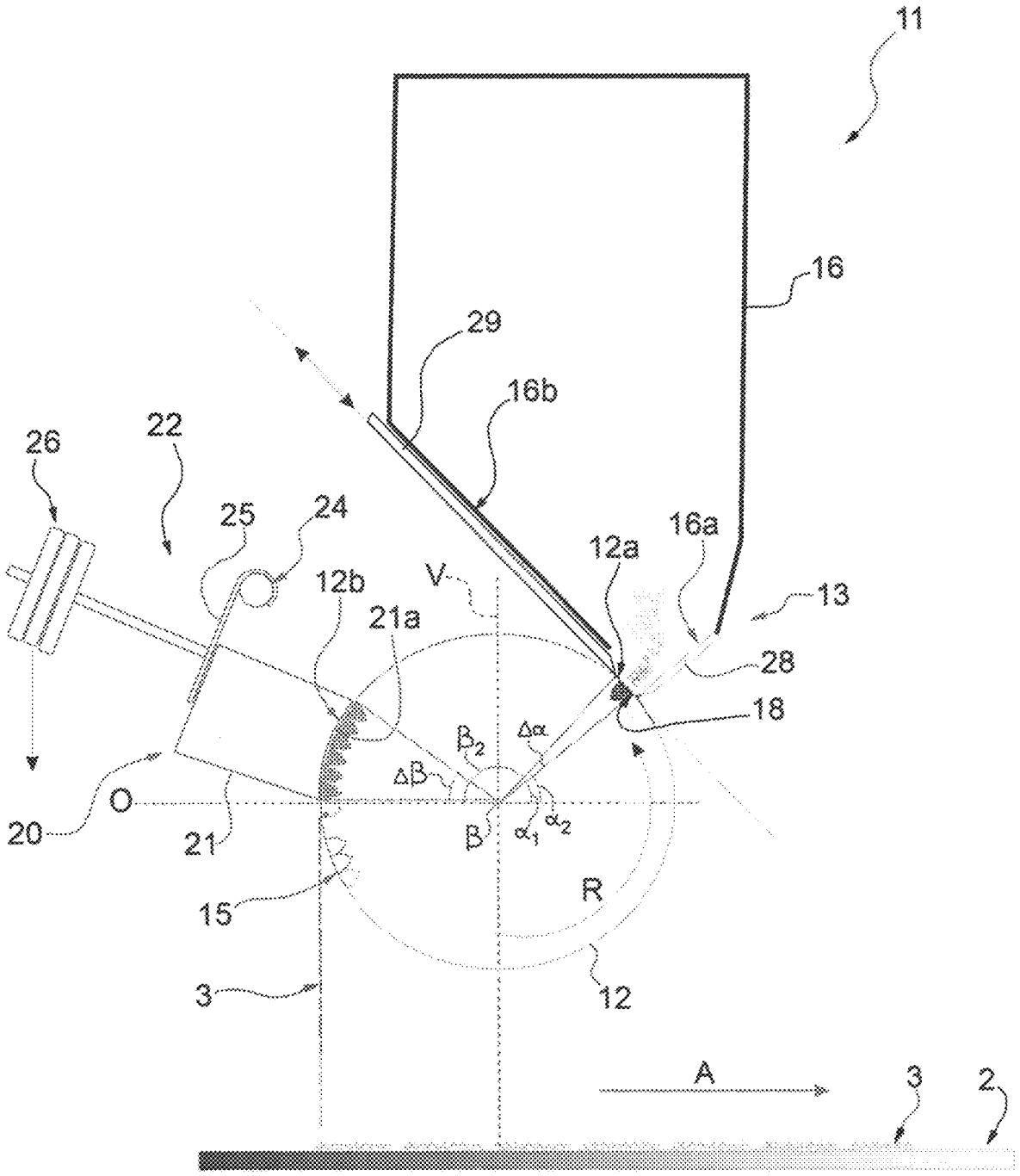
FIG. 2 schematically shows a machine for depositing grain-based decorations on the membrane comprised in the system shown in FIG. 1, and subject of the present invention.

With reference to FIGS. 1 and 2, the coating station 5 comprises at least a grain application machine 11, which is designed to receive covering grains 3 and deposits the covering grains 3 in a controlled manner on the hot semi-solid membrane 2 just preformed (still partially viscous at least on the surface), during the movement of the same along the direction A, thus forming on the preformed membrane 2 a superficial decorative covering on the basis of at least a predefined pattern.

Figure 3:
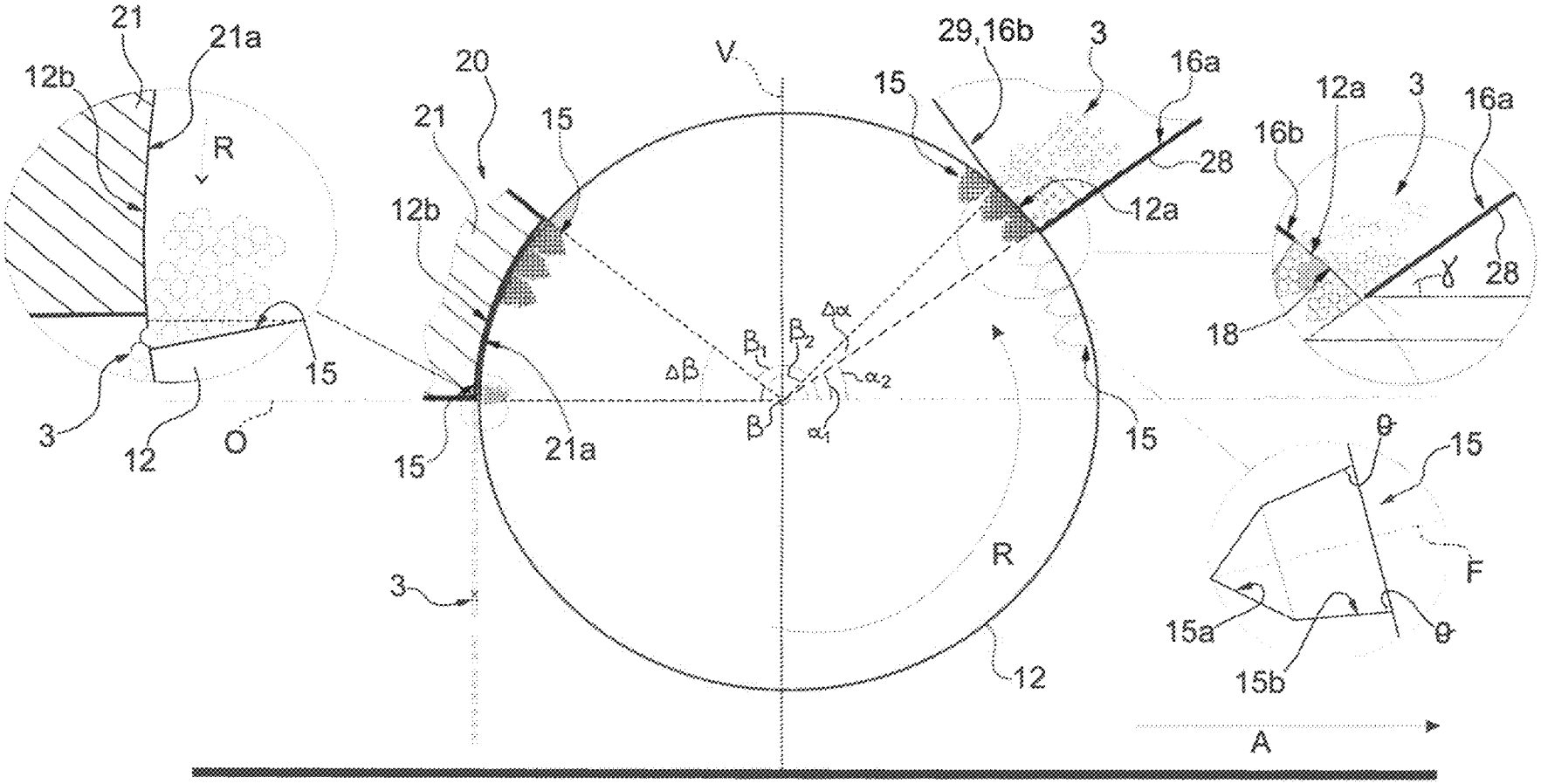
FIG. 3 schematically shows the application drum of the machine for depositing grain-based decorations shown in FIG. 2.

According to a preferred embodiment shown in FIGS. 1, 2 and 3, the grain application machine 11 comprises an application drum 12, which can be arranged above the membrane 2 at a determinate distance therefrom, to rotate around an axis B, thus receiving the covering grains 3 in a loading region 12*a* on the surface of the drum 12 and associated with an angular rotation interval $\Delta\alpha$ of the application drum 12, and deposits the covering grains 3 on the upper surface of the membrane 2 below, when the application drum 12, during the rotation, cross approximately an angular deposition position of the drum 12. Preferably, but not necessarily, the axis B can be horizontal and orthogonal to the direction A.

The grain application machine 11 further comprises a grain loading device 13, which is arranged at the loading region 12*a* of the application drum 12 and is structured to load the covering grains 3 in a controlled/dosed manner, in the loading region 12*a* of the application drum 12.

According to a preferred embodiment example shown in FIGS. 1 and 2, the application drum 12 can have a preferably cylindrical shape with a circular section. The application drum 12 can be made preferably, but not necessarily, of rigid non-deformable material, for example metallic or plastic material and the like. The application drum 12 can be rotated around the axis B by a drive unit provided with an electric motor M (shown in FIG. 4) preferably controlled by an electronic control system comprising for example the electronic control unit 10 and mechanically connected to the application drum 12 by means of a mechanical motion transmission system of known type and therefore not described in detail.

On the outer cylindrical surface of the application drum 12 cavities 15 are obtained, which are structured to each contain a predefined quantity of covering grains 3 and are arranged on the surface according to a predefined geometric distribution which depends on the superficial decorative covering to be produced on the membrane 2.

As regards the grain loading device 13, it can comprise a hopper 16, which is arranged approximately beside the upper part of the application drum 12 substantially at the back thereof, and has in the lower part, i.e. on the bottom, an opening 18 which faces the loading region 12*a* of the surface of the drum 12. The opening 18 is obtained on the bottom of the hopper 16 so that the covering grains 3 which come out of the opening 18 are deposited in the loading region 12*a* thus entering the cavities 15 therein.

According to a preferred embodiment example shown in FIG. 2, the hopper 16 is arranged so that the opening 18 is conveniently positioned facing the surface portion of the drum 12 within the angular rotation interval $\Delta\alpha$.

In the example illustrated in FIGS. 2 and 3, the angular rotation intervals $\Delta\alpha$ ranges between an angle $\alpha 2$ and an angle $\alpha 2$ both determined with respect to the horizontal centreline plane O of the drum 12 passing through the axis B. According to a preferred embodiment example, the angle $\alpha 1$ is approximately 37° while the angle $\alpha 2$ is approximately 45°.

According to a preferred embodiment shown in FIGS. 1 to 6, the grain application machine 11 further comprises a grain retention device 20, which is arranged beside the drum 12 on the opposite side of the opening 18 of the hopper 16 with respect to the vertical centreline plane V of the drum 12 passing through the axis B, in contact with the drum 12; this maintains the covering grains 3 in the cavities 15 when the latter are in a retention surface region 12*b* of the drum 12 within an angular rotation interval $\Delta\beta$ distinct from and subsequent to the angular rotation interval $\Delta\alpha$ in the direction R of rotation of the drum 12. Preferably the direction R can correspond to the feed direction A of the membrane 2. In FIGS. 2 and 3, R is anticlockwise and the direction A of the membrane is oriented towards the right side of the drawing.

In the example illustrated, the angular rotation interval $\Delta\beta$ is between an angle $\beta 1$ and an angle $\beta 2$ both determined with respect to the horizontal centreline plane O of the drum 12 passing through the axis B. According to a preferred embodiment example, the angle $\beta 1$ can be approximately 125° while the angle $\alpha 2$ can be approximately 180° while the angular rotation interval $\Delta\beta$ can be approximately 55°.

According to a preferred embodiment shown in FIGS. 2, 3, 5 and 6, the grain retention device 20 comprises a scraping device 21 comprising a scraper shaped so as to present a scraping face 21*a* arranged in contact with the retention region of the drum 12 in order to slide on it.

According to a preferred embodiment, the scraping device 21 can conveniently be made of a sintered polymer based material.

The Applicant has found that the scraping device 21 can be conveniently made of sintered polyethylene preferably at low pressure and high density. In fact, the Applicant has found that the scraping device 21 made of sintered polymer material, for example sintered polyethylene, has the technical effect of a high resistance to wear and, since it is self-lubricating, significantly reducing the surface wear on the drum 12. Tests carried out by the Applicant have shown that a sintered polyethylene particularly appropriate for producing the scraping device 21 can have a friction coefficient ranging from approximately 0.2 to 0.25, and a specific weight ranging from approximately 0.935 g/cm$^3$ to 0.98 g/cm$^3$. The tests performed by the Applicant have also highlighted that, for example, the sintered polyethylene named "POLIZENE®" could be appropriate for producing the substantially non-deformable scraping device 21.

According to a possible embodiment example shown in FIG. 2, the scraping device 21 is angularly fixed with respect to the drum 12 so that it remains in contact with the retention region 12*b* of the drum 12 during rotation thereof.

As shown in FIGS. 3, 4, 5 and 6, the scraping device 21 can comprise, for example, a scraper defined by an elongated shaped bar which extends along a longitudinal axis approximately parallel to the axis B and can have a cross section approximately polygonal, preferably square or rectangular. It is understood that the shape of the scraping device 21 is not limited to the sections listed above but can have different shapes suitable for retaining the grains 3 in the retention region.

Figure 6:
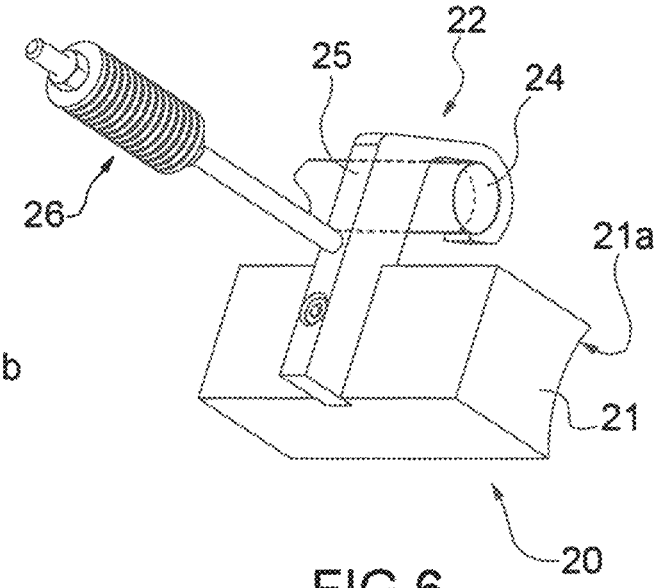
FIG. 6 is a perspective view of a grain retention device comprised in the machine subject of the present invention.

According to a possible embodiment example shown in FIGS. 2, 3 and 6, the scraping face 21*a* can be approximately arcuate, i.e. it has a section transverse to the longitudinal axis of the scraping device 21 having approximately the shape of a circle section. Preferably, the circle section can be approximately complementary to the portion of the transverse section of the drum 12 defining the retention region 12*b*.

According to a preferred embodiment shown in FIGS. 3 and 6, the arcuate scraping face 21*a* forms at its ends with the lateral walls of the scraping device 21 a first edge and a second edge. In the example of FIG. 3, the first edge of the scraping device 21 is arranged so as to form an angle with the horizontal centreline plane O corresponding to the angle $\beta 1$. In the example of FIG. 3, the second edge of the scraping device 21 is arranged so as to form an angle with the horizontal centreline plane O corresponding to the angle $\beta 2$.

Figure 5:
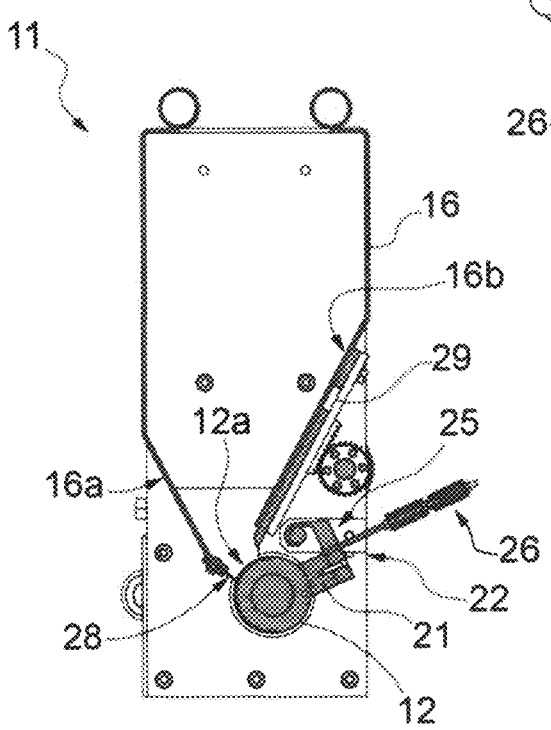
FIG. 5 is a section I-I of the machine shown in FIG. 4.

According to a preferred embodiment shown in FIGS. 2 and 5, the grain retention device 20 can further comprise a mechanical device 22 which is structured so as to exert a force on the scraping device 21 to maintain the scraping face 21*a* preferably in contact (in abutment) in a substantially adherent and uniform manner on the retention region of the drum 12 along the entire axial length of the scraper 21.

According to a possible embodiment example shown in FIGS. 2 and 6, the mechanical device 22 can comprise a rod or shaft 24 which can be positioned above the drum 12 and extends along a longitudinal axis approximately parallel to the axis B. The mechanical device 22 can further comprise a plurality of approximately vertical rocker arms or arms 25 which support at the bottom the scraping device 21 and at the top pivot on the shaft 24 so as to freely oscillate around it.

The mechanical device 22 can further comprise a plurality of counterweights 26 which are mechanically coupled/connected to the arms 25 preferably via stems 27 fixed to the arms 25. The counterweights 26 are designed to exert a force which pushes the scraping face 21*a* against the drum 12 in a direction approximately radial to it. According to a possible embodiment shown in FIG. 4, the arms 25 can be arranged parallel and equidistant from one another along the scraping device 21 so that the counterweights 26 distribute the force exerted on the scraping face 21*a* in a uniform manner over the entire axial length thereof.

As regards the hopper 16, according to an convenient embodiment, it can have on the bottom two lower walls, preferably but not necessarily flat and reciprocally inclined so as to converge at the ends. The two lower walls delimit with their ends the opening 18. In the example illustrated in FIGS. 2, 3 and 5, a wall 16*a* defines a slide which favours the loading of the grains 3 in the cavities 15 in the loading region 12*a*.

The wall 16*a* can be conveniently arranged on a plane radial to the drum 12 and passing through the axis B so as to be inclined by an angle γ with respect to the horizontal plane O. The Applicant has found that said inclination favours the controlled loading of the grains 3 in the cavities 15.

The Applicant has also found it convenient to produce the hopper 16 so that the other bottom wall 16*b* extends towards the drum 12 on a plane substantially tangent to the drum 12. Said positioning advantageously prevents the raising of an excessive number of granules since the wall 16*b* performs a smoothing action on the cylinder 12.

In an embodiment example shown in FIG. 2, the wall 16*a* can present a terminal portion folded inwards, which supports in a stable manner a scraper 28 arranged approximately in contact with the drum 12. The scraper 28 is structured to scrape the grains 3 from the surface of the drum 12 during loading, thus causing them to enter the cavities 15. The scraper 28 is further structured to clean the grains 3 from the contact surface of the drum 12.

Figure 4:
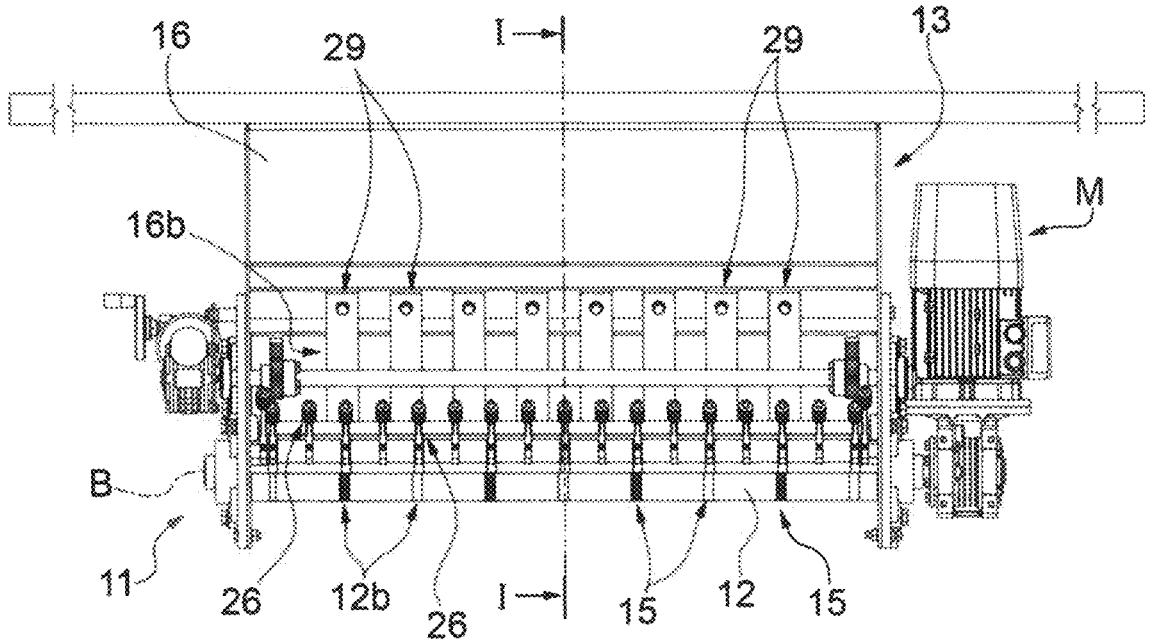
FIG. 4 is a front elevation view of an embodiment of the machine for depositing grain-based decorations subject of the present invention.

In an embodiment example shown in FIGS. 4 and 5, the scraper 28 can comprise for example a rectangular plate-like body with an elongated shape, which extends along an axis parallel to the axis B and has a preferably approximately rectilinear free end which is arranged in contact with the drum 12 for approximately the entire axial length thereof.

In the example illustrated, the scraper 28 extends from the folded terminal portion of the wall 16*a*, preferably coplanar with it, so that it is inclined with respect to the horizontal plane O preferably by an angle corresponding approximately to the angle α1. The Applicant has found that the scraper 28 can be advantageously made of sintered polyethylene preferably at low pressure and high density. It is understood that the scraper 28 could be integrated in the terminal part of the wall 16*a* or be formed therefrom.

With reference to FIG. 2, the hopper 16 can further comprise preferably at the wall 16*b*, a dosing door 29 moving on a movement plane from and towards a closing position of the opening 18, therefore adjusting the quantity of covering grains 3 loaded from the hopper 16 into the cavities 15 of the drum 12.

Preferably, the movement plane of the dosing door 29 can be approximately tangent to the drum 12. Preferably the movement plane can be tangent to the drum 12 and the movement of the dosing door on the plane allows variation of the angle α2.

According to one embodiment, the dosing door 29 can be mounted in a sliding manner on the wall 16*b* of the hopper 16 by means of appropriate guides (not illustrated), to move over the movement plane, from and towards the contact end of the scraper 28 with the drum 12, in order to vary the dimension of the opening 18 and therefore adjust the quantity of grains discharged from the hopper 16. The dosing door 29 can be moved on the movement plane via electric movement means (not illustrated), for example linear electric actuators or electric motors driven by an electronic control system, for example the electronic control unit 10. The dimension of the opening 18 can be varied to dose the quantity of grains 3 loaded on the drum 12 on the basis of one or more control parameters of the system 1 and/or of the membrane 2. For example, the control parameters can be the feeding speed of the membrane 2, and/or the density of grains 3 to be deposited on the membrane 2, and/or the dimensions of the grains.

With reference to FIG. 3, the cavities 15 are obtained on the surface of the drum 12 one approximately beside the other in approximately adjacent positions, having relative longitudinal axes preferably arranged in positions approximately radial to the drum 12. Preferably, the longitudinal axes of the cavities 15 can be approximately coplanar to the plane on which the scraper 28 lies.

With reference to a preferred embodiment, shown in FIG. 3, the cavities 15 have a longitudinal axis F and can be formed by an inner portion 15*a* and an outer portion 15*b*. The inner portion 15*a* can have an approximately triangular axial section whereas the outer portion 15*b* can have an approximately trapezoidal axial section. The Applicant has found that the trapezoidal section allows complete emptying of the cavities, a condition that cannot be obtained for example with a rectangular section in which the grains tend to get caught in the cavity.

Preferably the oblique sides of the outer portion 15*b* form an angle θ less than 90° with the outer surface of the drum 12 which surrounds the cavity 15.

The density and reciprocal positioning of the cavities 15 on the surface of the drum 12 depends on the decoration to be provided and/or the aesthetic effect to be obtained.

In the example shown in FIG. 1, the system 1 comprises a plurality of grain application machines 11, which are arranged one after the other in the feed direction A. In the example illustrated, the machines are structured to provide on the membrane respective decorations that graphically represent the modular elements used for cover roofs, such as shingles, and flat or curved tiles.

A first application machine 11 can be structured to deposit on the upper face of the preformed hot and semi-solid membrane 2 that is fed forward below the drum 12, first fine/thin grains to provide on said face lines that define the edge/contour of the graphic modular element. Preferably, the grains defining the contour of the modular elements can be black. The first grains are deposited in a controlled manner on the hot semi-solid membrane 2 thus embedding/sinking into the surface thereof. Preferably the first grains can have a granulometry smaller than approximately 0.7 mm, preferably smaller than or equal to approximately 0.63 mm.

A second application machine 11, arranged downstream of the first application machine 11, can be structured to deposit on the upper face of the membrane 2 second large grains, i.e. thicker than the first grains, so as to completely cover the upper face. Preferably the large grains can have a granulometry ranging between approximately 0.7 and approximately 1.5 mm, preferably ranging from approximately 0.63 mm to approximately 1.25 mm.

During the application, a certain quantity of second grains is deposited over the first grains which prevent sticking thereof to the membrane 2 while another quantity of grains is deposited in the uncovered bituminous areas of the membrane 2 and remain stuck thereto, thus colouring the inner space delimited by the contours. Preferably, the large grains defining the larger visible surface of the modular elements can be red or green or other similar colours.

During a subsequent cooling phase, the membrane 2 changes its state from semi-solid to solid, and the grains 3 deposited are rigidly/stably fixed on the surface of the membrane 2 thus defining the permanent surface decoration.

The second grains that remain free, i.e. not attached to the face of the membrane 2, can be easily separated therefrom. For this purpose, the system 1 can comprise, for example, a recovery tank for recovering the grains arranged downstream of the second application machine 11, while the movement means can be structured to overturn the cooled membrane 2 above the grain recovery tank thus inverting/overturning the upper face so that the second grains left free (not attached) are deposited by gravity in the tank below. It is understood that the free grains could be sucked by a suction device (not illustrated) or separated from the membrane by other separation means of known type.

From the above description it is evident that the structure of the application machine 11 allows the grains to be conveniently dosed and distributed accurately on the membrane 2 without causing overlapping thereof, thus guaranteeing complete fixing of all the grains deposited thereon. Advantageously, in the system provided with two application machines and produced as described above, this results only in an overlapping of large grains on the contours of the decoration obtained with fine grains of the membrane. This prevents mixing between fine and large grains and allows complete recovery of the large grains with all the consequent advantages in terms of reduction of waste and costs.

It has therefore been shown that the present invention allows achievement of the above objectives.

Lastly, it is clear that modifications and variations can be made to the method, the machine and the system described and illustrated here without departing from the scope of the present invention defined by the attached claims.

What is claimed is:

1. A system to produce a bitumen-based membrane provided with a bituminous surface covered by grains, said system comprising:

a movement device that moves a preformed membrane in a predefined feed direction; and at least a grain application machine designed to cover the preformed membrane with grains and comprising in turn:

an application drum which is designed to rotate around a rotation axis and is provided with a plurality of cavities which are designed to receive grains in a loading region of said application drum and discharge the grains so as to deposit them by gravity on the preformed membrane below when the cavities are in an angular discharge position of the application drum;

a grain loading device designed to load the grains in the cavities in the loading region of the application drum;

wherein said grain application machine further comprises a grain retention device made of sintered polymer material, which is arranged in contact with a retention region for retaining the outer surface of the application drum so as to maintain the grains in the cavities until the latter reach said angular discharge position, and wherein the grain retention device comprises:

a shaft which extends along an axis approximately parallel to a longitudinal axis approximately parallel to the rotation axis, at least one arm which supports a scraper device at a bottom of the at least one arm and pivots at a top of the at least one arm on said shaft so as to freely oscillate around the same, and at least one counterweight mechanically coupled/connected to said arm.

2. The system according to claim 1, wherein said grain loading device comprises a hopper containing the grains, the hopper has an opening for discharging the grains onto the application drum and is arranged adjacent to the loading region of the application drum, and the opening and the grain retention device being arranged in the area of respective sides of the application drum, which are reciprocally opposite with respect to a vertical centreline plane of the application drum passing through the rotation axis of the application drum.

3. The system according to claim 2, wherein said loading region is associated with a first angular rotation interval of said application drum between a first rotation angle and a second rotation angle, and wherein the hopper is provided with a bottom wall which delimits said opening and is inclined with respect to a horizontal plane by an angle approximately equal to said first rotation angle of the application drum so as to form a grain discharge slide.

4. The system according to claim 2, wherein said hopper is provided in the area of said opening with a dosing door which moves on a plane approximately tangent to said application drum in said loading region to regulate the quantity of granules loaded in said application drum.

5. The system according to claim 3, wherein said retention region is associated with a second angular rotation interval of said application drum between a third rotation angle and a fourth rotation angle, and wherein the fourth rotation angle is approximately 180° with respect to a horizontal centreline plane of the application drum passing through said rotation axis.

6. The system according to claim 1, wherein the grain retention device comprises the scraper device which is angularly fixed with respect to the application drum and comprises a scraper with elongated shape which extends so as to remain adherent exclusively to the retention region of the application drum along the longitudinal axis approximately parallel to the rotation axis.

7. The system according to claim 1, wherein said cavities have an inner portion and an outer portion; the inner portion has an approximately triangular axial section, the outer portion has an approximately trapezoidal axial section.

8. A method for producing a bitumen-based membrane provided with a bituminous surface covered by grains, the method performed by a system comprising: a movement device that moves a preformed membrane in a predefined feed direction, and at least a grain application machine designed to cover the preformed membrane with grains and comprising in turn: an application drum which is designed to rotate around a rotation axis and is provided with a plurality of cavities which are designed to receive grains in a loading region of said application drum and discharge the grains so as to deposit them by gravity on the preformed membrane below when the cavities are in an angular discharge position of the application drum; a grain loading device designed to load the grains in the cavities in the loading region of the application drum; wherein said grain application machine further comprises a grain retention device made of sintered polymer material, which is arranged to be in contact with a retention region for retaining the outer surface of the application drum so as to maintain the grains in the cavities until the latter reach said angular discharge position, and wherein the grain retention device comprises: a shaft which extends along an axis approximately parallel to a longitudinal axis approximately parallel to the rotation axis, at least one arm which supports a scraper device at a bottom of the at least one arm and pivots at a top of the at least one arm on said shaft so as to freely oscillate around the same, and at least one counterweight mechanically coupled/connected to said arm; and said method comprising:

moving the preformed membrane in a predefined feed direction by the movement device;

rotating the application drum, provided on the outer surface with the cavities for containing grains, around the rotation axis; and during the rotation of the application drum around said rotation axis, loading the grains into the cavities of the application drum in the loading region of said application drum and subsequently discharging the grains from the cavities so as to deposit the grains by gravity on the preformed membrane below;

wherein the grain retention device made by the sintered polymer material is placed in contact with the retention region of the outer surface of the application drum in order to maintain the grains in the cavities until the latter reach the predefined angular discharge position.

9. A machine for covering a preformed membrane with grains comprising an application drum which is designed to rotate around a rotation axis, and is provided with a plurality of cavities which are designed to receive grains in a loading region of said application drum and discharge the grains so as to deposit them by gravity on a preformed membrane below when the cavities are in an angular discharge position of the application drum, a grain loading device designed to load the grains into the cavities in the loading region of the application drum; said grain application machine further comprises a grain retention device based on a sintered polymer material, which is arranged in contact with a retention region of the outer surface of the application drum so as to maintain the grains in the cavities until the latter reach said angular discharge position; and wherein the grain retention device comprises: a shaft which extends along an axis approximately parallel to a longitudinal axis approximately parallel to the rotation axis, at least one arm which supports a scraper device at a bottom of the at least one arm and pivots at a top of the at least one arm on said shaft so as to freely oscillate around the same, and at least one counterweight mechanically coupled/connected to said arm.

* * * * *